US010397726B2

(12) United States Patent
McGibney

(10) Patent No.: US 10,397,726 B2
(45) Date of Patent: Aug. 27, 2019

(54) METHOD, APPARATUS, AND COMPUTER-READABLE MEDIA FOR FOCUSING SOUND SIGNALS IN A SHARED 3D SPACE

(71) Applicant: Nureva, Inc., Calgary (CA)

(72) Inventor: Grant Howard McGibney, Calgary (CA)

(73) Assignee: Nureva, Inc. (CA)

( * ) Notice: Subject to any disclaimer, the term of this patent is extended or adjusted under 35 U.S.C. 154(b) by 0 days.

(21) Appl. No.: 16/110,393

(22) Filed: Aug. 23, 2018

(65) Prior Publication Data

US 2018/0367938 A1 Dec. 20, 2018

Related U.S. Application Data

(63) Continuation of application No. 15/597,646, filed on May 17, 2017, now Pat. No. 10,063,987.

(Continued)

(51) Int. Cl.

*H04S 7/00* (2006.01)
*H04R 3/00* (2006.01)

(Continued)

(52) U.S. Cl.

CPC ..... *H04S 7/303* (2013.01); *H04R 1/406* (2013.01); *H04R 3/005* (2013.01); *H04R 29/005* (2013.01);

(Continued)

(58) Field of Classification Search

CPC ..... H04S 7/303; H04S 2400/15; H04R 1/406; H04R 3/005; H04R 29/005; H04R 2201/401

See application file for complete search history.

(56) References Cited

U.S. PATENT DOCUMENTS 6,912,178 B2 6/2005 Chu et al.
7,489,788 B2 2/2009 Leung et al.

(Continued)

FOREIGN PATENT DOCUMENTS

JP 3154468 B2 4/2001

OTHER PUBLICATIONS

International Search Report and Written Opinion for International Application No. PCT/CA2017/050642 dated Sep. 15, 2017.

(Continued)

*Primary Examiner* — Andrew L Sniezek
(74) *Attorney, Agent, or Firm* — Katten Muchin Rosenman LLP

(57) ABSTRACT

Focusing sound signals in a shared 3D space uses an array of physical microphones, preferably disposed evenly across a room to provide even sound coverage throughout the room. At least one processor coupled to the physical microphones does not form beams, but instead preferably forms 1000's of virtual microphone bubbles within the room. By determining the processing gains of the sound signals sourced at each of the bubbles, the location(s) of the sound source(s) in the room can be determined. This system provides not only sound improvement by focusing on the sound source(s), but with the advantage that a desired sound source can be focused on more effectively (rather than steered to) while un-focusing undesired sound sources (like reverb and noise) instead of rejecting out of beam signals. This provides a full three dimensional location and a more natural presentation of each sound within the room.

27 Claims, 9 Drawing Sheets

Related U.S. Application Data

(60) Provisional application No. 62/343,512, filed on May 31, 2016.

(51) Int. Cl.
*H04R 1/40* (2006.01)
*H04R 29/00* (2006.01)

(52) U.S. Cl.
CPC .... *H04R 2201/401* (2013.01); *H04S 2400/15* (2013.01)

(56) References Cited

U.S. PATENT DOCUMENTS

| | | | | |
|---|---|---|---|---|
| 8,953,819 | B2 | 2/2015 | Ko et al. | |
| 10,003,900 | B2 * | 6/2018 | Cartwright | H04S 7/30 |
| 10,063,987 | B2 * | 8/2018 | McGibney | H04R 29/005 |
| 2008/0285771 | A1 * | 11/2008 | Tanaka | H04M 3/56 381/92 |
| 2012/0093344 | A1 | 4/2012 | Sun et al. | |
| 2013/0142342 | A1 | 6/2013 | Del Galdo et al. | |
| 2014/0050328 | A1 | 2/2014 | Fischer | |
| 2014/0098964 | A1 | 4/2014 | Rosca et al. | |
| 2014/0314251 | A1 * | 10/2014 | Rosca | H04R 3/005 381/92 |
| 2015/0230026 | A1 | 8/2015 | Eichfeld et al. | |
| 2017/0366896 | A1 | 12/2017 | Adsumilli et al. | |
| 2017/0374454 | A1 | 12/2017 | Bernardini et al. | |

OTHER PUBLICATIONS

Joseph Hector Dibiase, Thesis entitled, "A High-Accuracy, Low-Latency Technique for Talker Localization in Reverberant Environments Using Microphone Arrays", Brown University, May 2000.

Extended European Search Report for European Patent Application No. 17805437.5 dated May 7, 2019.

* cited by examiner

Figure 1a (100) Sound Pressure Relationship

110

P~ 1/r
P = Sound pressure
R= Distance

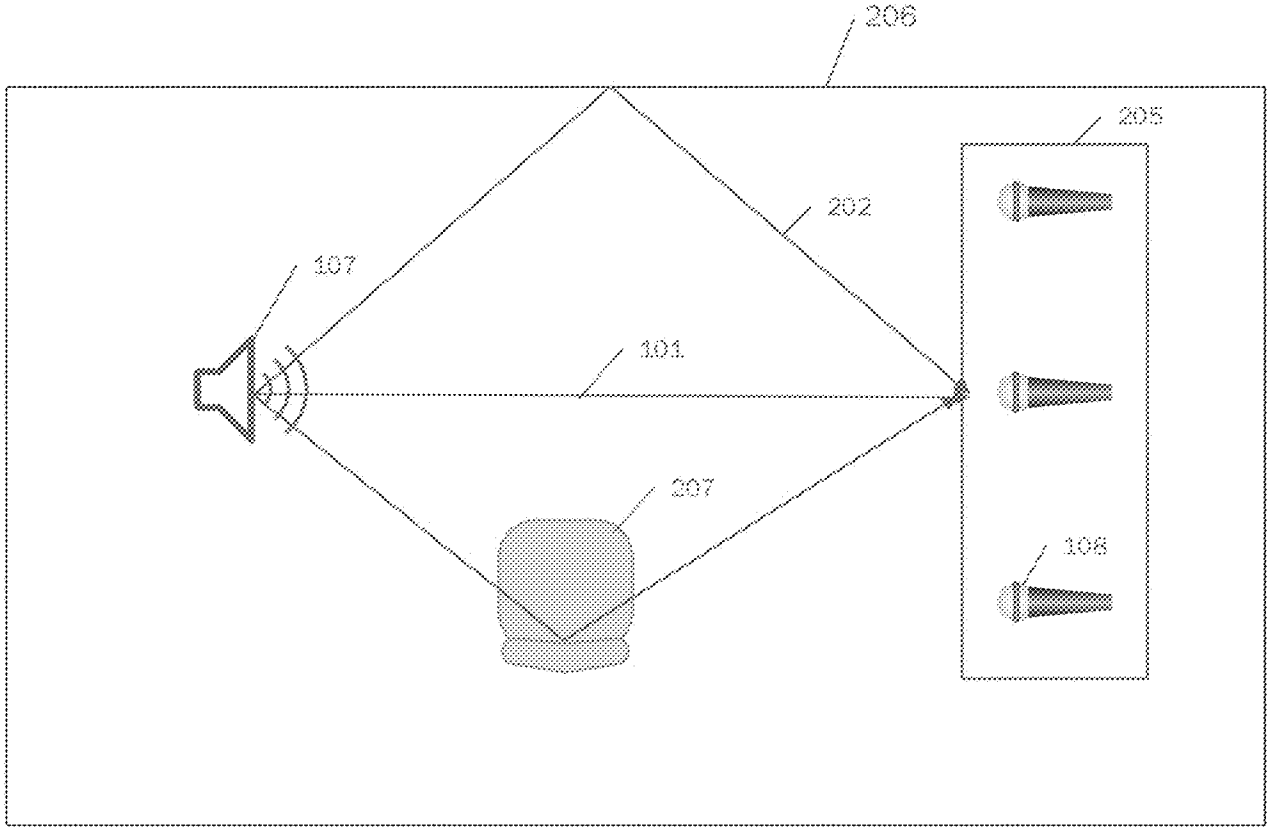
Figure 2 Direct and Reflected Signals Relationship

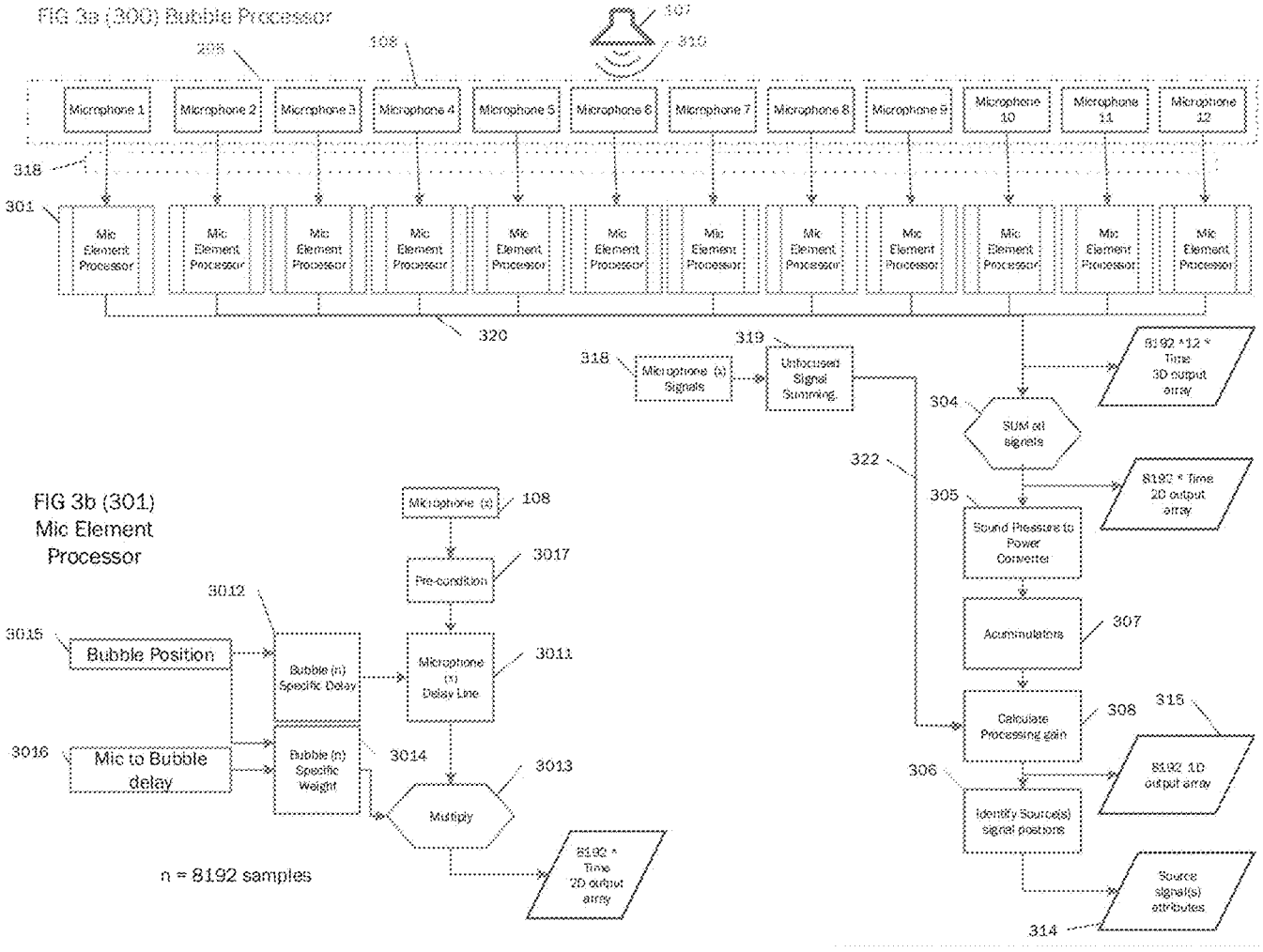
FIG 3a (300) Bubble Processor
Microphone 1
Microphone 2
Microphone 3
Microphone 4
Microphone 5
Microphone 6
Microphone 7
Microphone 8
Microphone 9
Microphone 10
Microphone 11
Microphone 12
Mic Element Processor
8192 * 12 * Time 3D output array
8192 * Time 2D output array
SUM all signals
Sound Pressure to Power Converter
Accumulations
Calculate Processing gain
Identify Source(s) signal positions
8192 1D output array
Source signal(s) attributes
Unfocused Signal Summing
Microphone (n) Signals
Microphone (n)
Pre-condition
Microphone (n) Delay Line
Multiply
Bubble (n) Specific Delay
Bubble (n) Specific Weight
Bubble Position
Mic to Bubble delay
n = 8192 samples
FIG 3b (301) Mic Element Processor
107
108
109
110
301
304
305
306
307
308
314
315
318
319
320
322
3011
3012
3013
3014
3015
3016
3017

FIG 4 (400) 3D Microphone Measurement
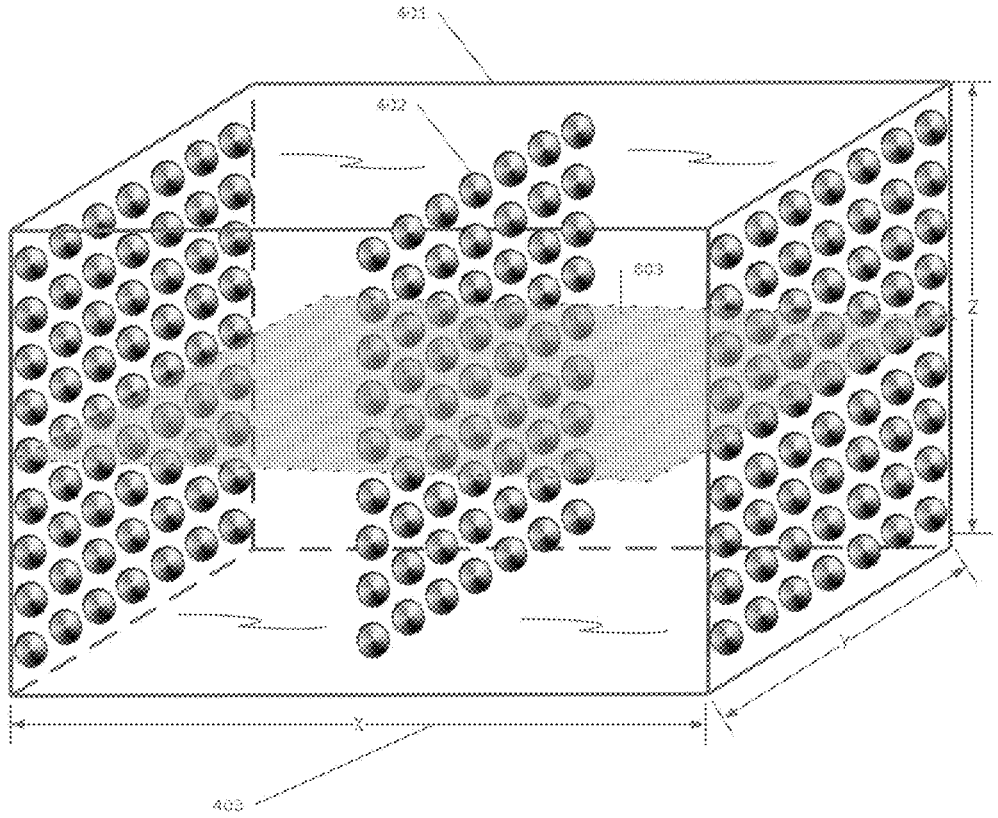

FIG 5a (3011) Microphone to Sound Source Delay processing
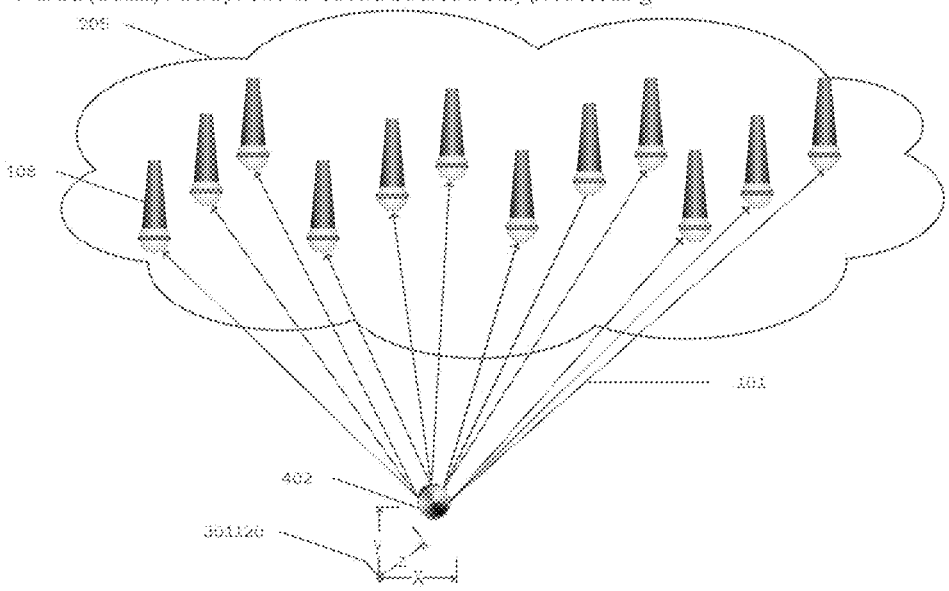
FIG 5b
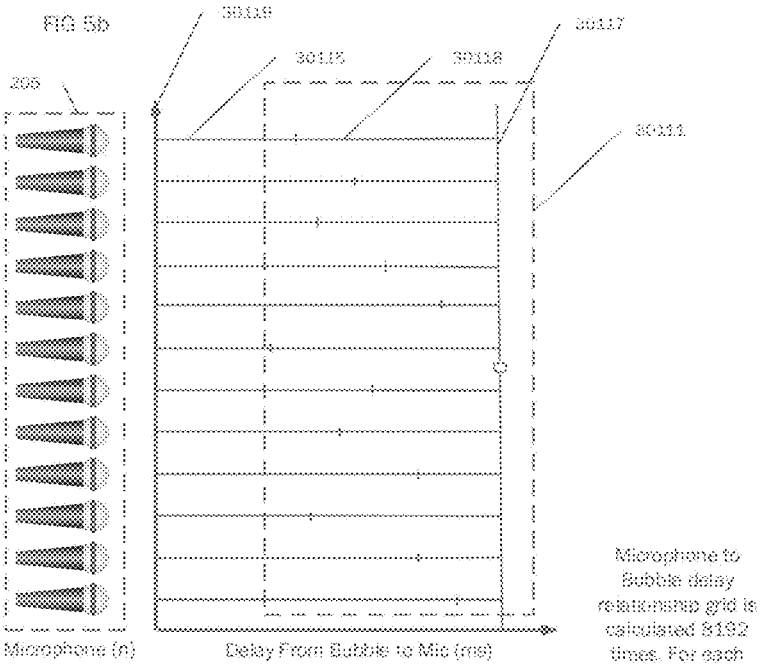
Microphone to Bubble delay relationship grid is calculated 8192 times. For each combination

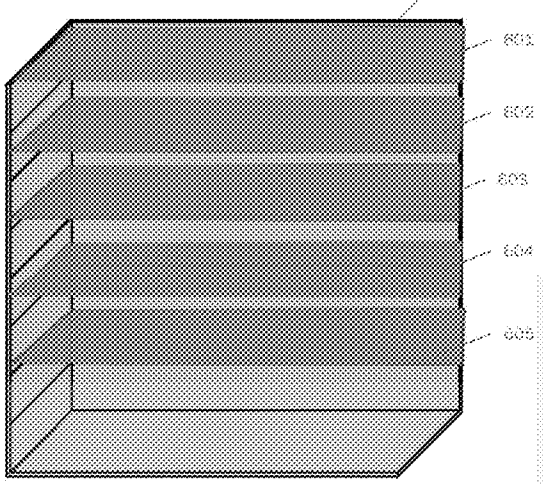
FIG 6a (600) Room showing Bubble Processor Plane Layout
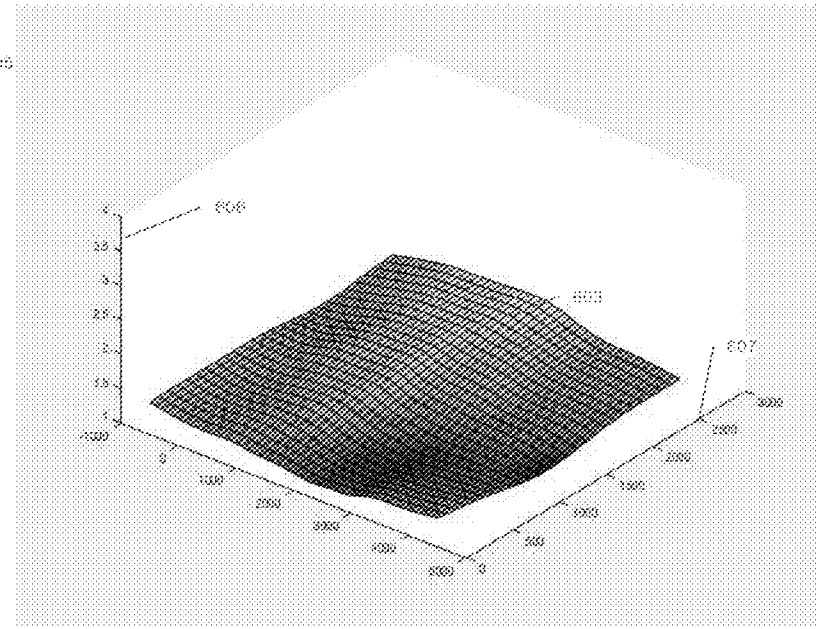
FIG 6b (600) Data from a Room Plane with no Active Sound Source Present

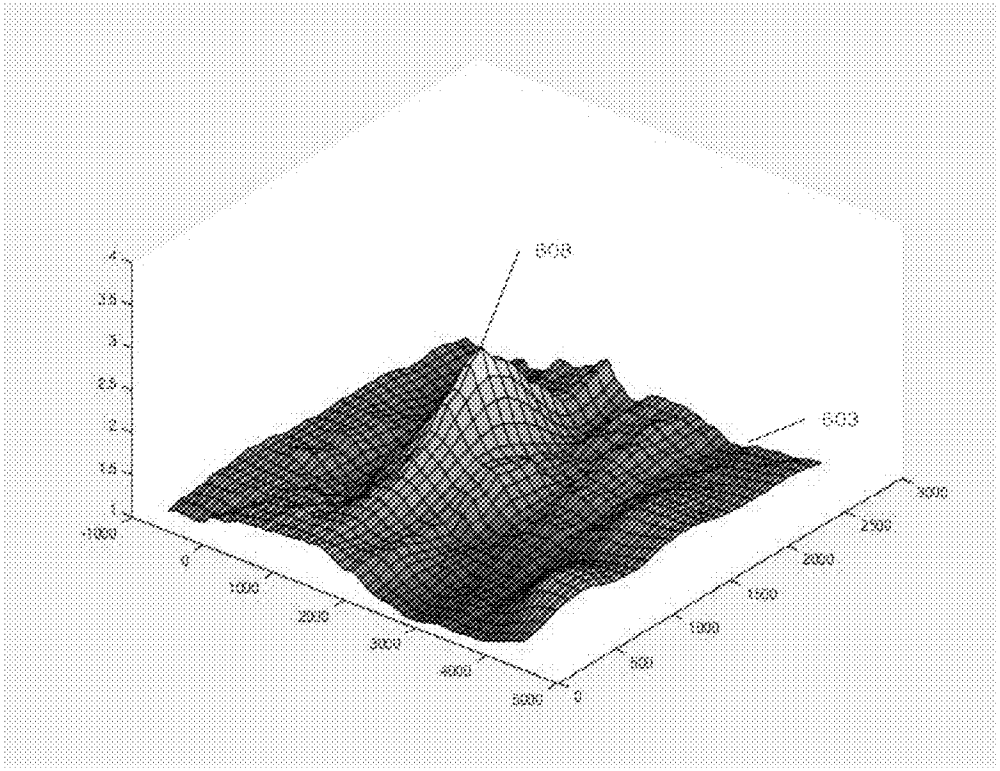
FIG 6c (600) Data from a Room Plane with an active Sound Source present FIG 7 (700) 2D Microphone Measurement
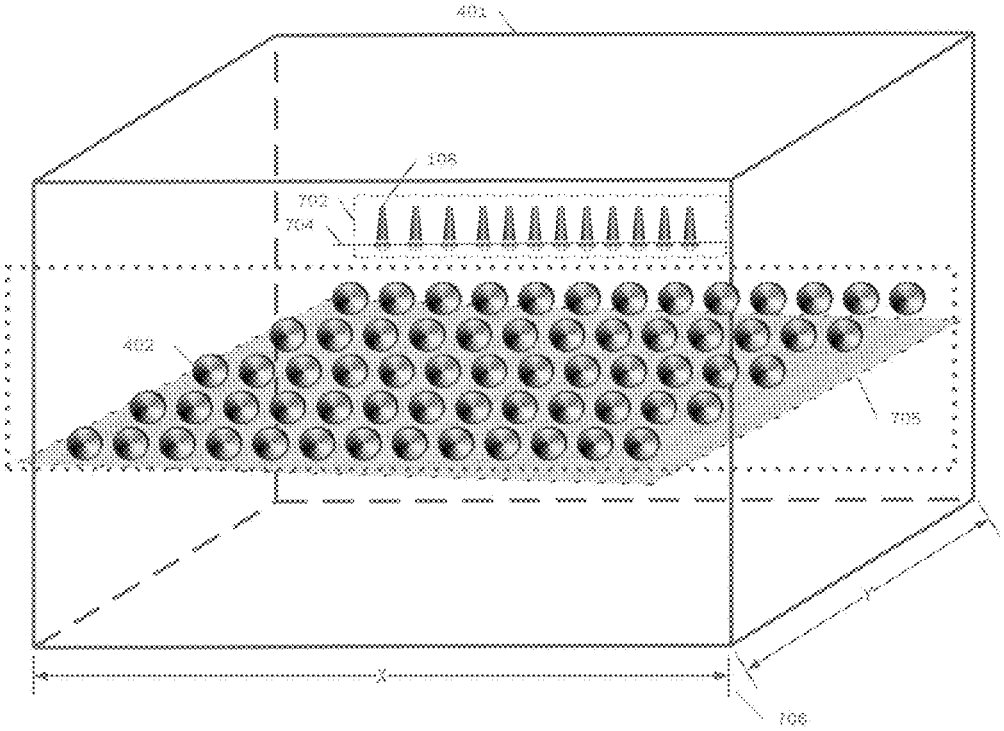
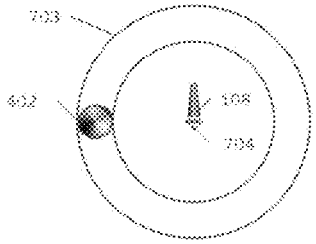
Side View - Microphone to bubble relationship perspective drawing with the axis of the microphone line in the middle of the circles FIG 8 (800) Microphone Focusing
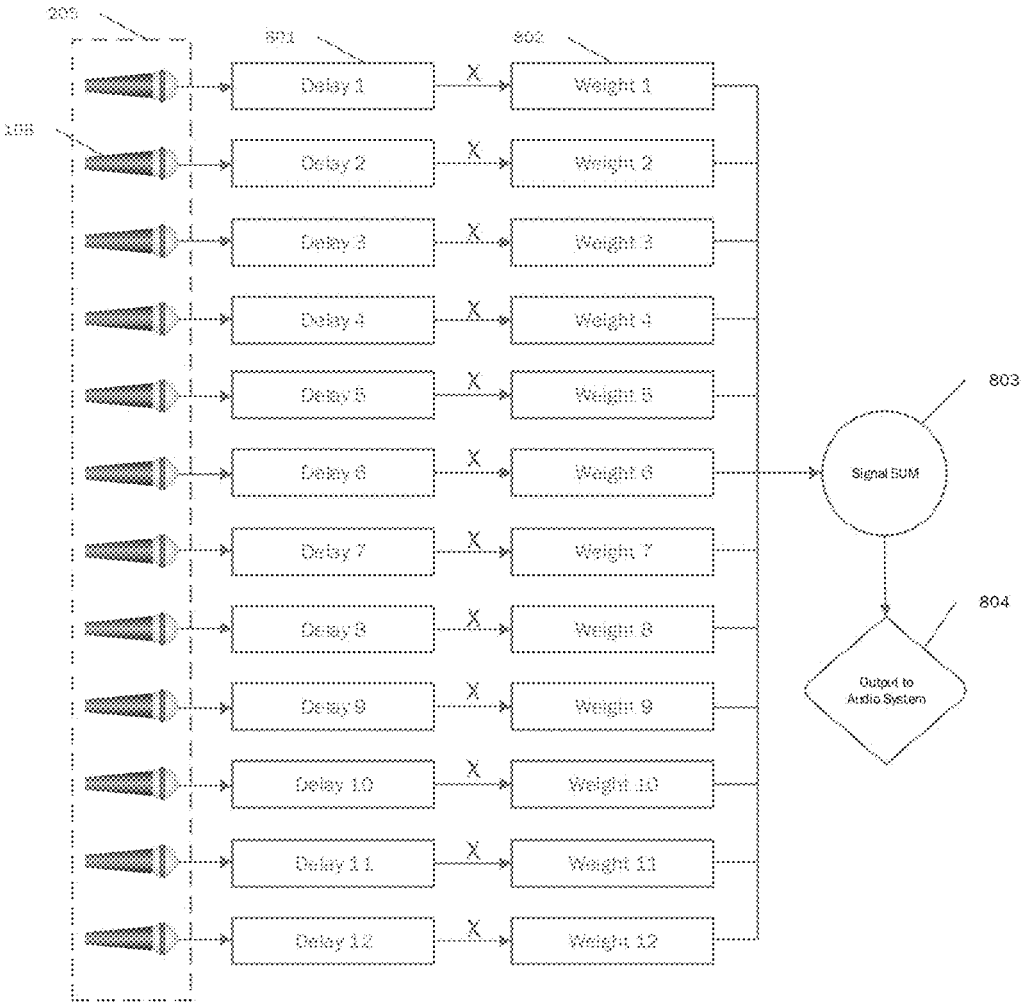

METHOD, APPARATUS, AND COMPUTER-READABLE MEDIA FOR FOCUSING SOUND SIGNALS IN A SHARED 3D SPACE

This application is a continuation of U.S. patent application Ser. No. 15/597,646, filed May 17, 2017, now U.S. Pat. No. 10,063,987 which claims priority to U.S. Provisional Patent Application No. 62/343,512, filed May 31, 2016, the entire contents of all incorporated herein by reference.

TECHNICAL FIELD OF THE INVENTION

The present invention generally relates to 3D spatial sound power and position determination to focus a dynamically configured microphone array in near real-time for multi-user conference situations.

BACKGROUND

There have been different approaches to solve the issues in regards to managing noise sources, and steering and switching microphone pickup devices to enhance a multi-user room's capability for conferencing. Obtaining high quality audio at both ends of a conference call is difficult to manage due to, but not limited to, variable room dimensions, dynamic seating plans, known steady state and unknown dynamic noise sources. Because of the complex needs and requirements, solving the problems has proven difficult and insufficient.

Traditional methods typically approach the issue with distributed microphones to enhance sound pick up as the microphones are generally located close to the participants and the noise sources are usually more distant, but not always. This allows for good sound pick up; however each participant needs a microphone for best results, which increases the complexity of the hardware and installation. Usually the system employs microphone switching and post-processing, which can degrade the audio signal through the addition of unwanted artifacts, resulting from the process of switching between microphones. Adapting to participants standing at white boards, projection screens and other non-seated locations is usually not handled acceptably. Dynamic locations could be handled through wireless apparel or situational microphones and although the audio can be improved, such microphones do not incorporate positional information only audio information.

Another method to manage dynamic seating and participant positions is with microphone beam arrays. The array is typically located on a wall or ceiling environment. The arrays can be steered to help direct the microphones on desired sounds so the sound sources can be tracked and theoretically optimized for dynamic participant locations.

In the current art, microphone beam forming arrays are arranged in specific geometries in order to create microphone beams that can be steered towards the desired sound. The advantage of the beam method is that there is a gain in sound quality with a relatively simple control mechanism. Beams can only be steered in one dimension (in the case of a line array) or in two dimensions (in the case of a 2-D array). The disadvantage of beam formers is that they cannot locate a sound precisely in a room, only its direction and magnitude. This means that the array can locate the general direction as per a compass-like functionality, giving a direction vector based on a known position, which is a relative position in the room. This method is prone to receiving equally, direct signals and potential multi-path (reverberation), resulting in false positives which can potentially steer the array in the wrong direction.

Another drawback is that the direction is a general measurement and the array cannot distinguish between desirable and undesirable sound sources in the same direction, resulting in all signals picked-up having equal noise rejection and gain applied. If multiple participants are talking, it becomes difficult to steer the array to an optimal location, especially if the participants are on opposite sides of the room. The in-room noise and desired sound source levels will be different between pickup beams requiring post-processing which can add artifacts and processing distortion as the post processor normalizes the different beams to try and account for variances and to minimize differences to the audio stream. Since the number of microphones that are used tends to be limited due to costs and installation complexity, this creates issues with fewer microphones available to do sound pick-up and location determination. Another constraint with the current art is that microphone arrays do not provide even coverage of the room, as all of the microphones are located in close proximity to each other because of design considerations of typical beam forming microphone arrays. The Installation of 1000s of physical microphones is not typically feasible in a commercial environment due to building, shared space, hardware and processing constraints where traditional microphones are utilized, through normal methods established in the current art.

An approach in the prior art is to use frequency domain delay estimation techniques for maximum sound source location targeting. However, frequency domain systems in this field require substantial memory resources and computational power, leading to slower and less-exact solutions.

U.S. Pat. No. 6,912,178 discloses a system and method for computing a location of an acoustic source. The method includes steps of processing a plurality of microphone signals in frequency space to search a plurality of candidate acoustic source locations for a maximum normalized signal energy.

U.S. Pat. No. 4,536,887 describes microphone array apparatus and a method for extracting desired signals therefrom in which an acoustic signal is received by a plurality of microphone elements. The element outputs are delayed by delay means and weighted and summed up by weighted summation means to obtain a noise-reduced output. A "fictitious" desired signal is electrically generated and the weighting values of the weighted summation means are determined based on the fictitious desired signal and the outputs of the microphone elements when receiving only noise but no input signal. In this way, the adjustments are made without operator intervention. The requirement of an environment having substantially only noise sources, however, does not realistically reflect actual sound pickup situations where noise, reverberation and sound conditions change over relatively short time periods and the occurrence of desired sounds is unpredictable. It is an object of the '887 patent to provide improved directional sound pickup that is adaptable to varying environmental conditions without operator intervention or a requirement of signal-free conditions for adaptation.

The article, "A High-Accuracy, Low-Latency Technique for Talker Localization in Reverberant Environments Using Microphone Arrays", Joseph Hector DiBiase, May 2000, discloses attempts to show that pairwise localization techniques yield inadequate performance in some realistic small-room environments. Unique array data sets were collected using specially designed microphone array-systems. Through the use of this data, various localization methods were analyzed and compared. These methods are based on both the generalized cross-correlation (GCC) and the steered response power (SRP). The GCC techniques studied include the phase transform, which has been dubbed "GCC-PHAT". The beam-steering methods are based on the conventional steered response power (SRP) and a new filter-and-sum technique dubbed "SRP-PHAT".

U.S. Pat. No. 6,593,956 B1 describes a system, such as a video conferencing system, which includes an image pickup device, an audio pickup device, and an audio source locator. The image pickup device generates image signals representative of an image, while the audio pickup device generates audio signals representative of sound from an audio source, such as speaking person. The audio source locator processes the image signals and audio signals to determine a direction of the audio source relative to a reference point. The system can further determine a location of the audio source relative to the reference point. The reference point can be a camera. The system can use the direction or location information to frame a proper camera shot which would include the audio source EU. Patent No EP0903055 B1 describes an acoustic signal processing method and system using a pair of spatially separated microphones (10, 11) to obtain the direction (80) or location of speech or other acoustic signals from a common sound source (2). The description includes a method and apparatus for processing the acoustic signals by determining whether signals acquired during a particular time frame represent the onset (45) or beginning of a sequence of acoustic signals from the sound source, identifying acoustic received signals representative of the sequence of signals, and determining the direction (80) of the source, based upon the acoustic received signals. The '055 patent has applications to videoconferencing where it may be desirable to automatically adjust a video camera, such as by aiming the camera in the direction of a person who has begun to speak.

U.S. Pat. No. 7,254,241 describes a system and process for finding the location of a sound source using direct approaches having weighting factors that mitigate the effect of both correlated and reverberation noise. When more than two microphones are used, the traditional time-delay-of-arrival (TDOA) based sound source localization (SSL) approach involves two steps. The first step computes TDOA for each microphone pair, and the second step combines these estimates. This two-step process discards relevant information in the first step, thus degrading the SSL accuracy and robustness, in the '241 patent, direct, one-step, approaches are employed. Namely, a one-step TDOA SSL approach and a steered beam (SB) SSL approach are employed. Each of these approaches provides an accuracy and robustness not available with the traditional two-step approaches.

U.S. Pat. No. 5,469,732 B1 describes an apparatus and method in a video conference system that provides accurate determination of the position of a speaking participant by measuring the difference in arrival times of a sound originating from the speaking participant, using as few as four microphones in a 3-dimensional configuration. In one embodiment, a set of simultaneous equations relating the position of the sound source and each microphone and relating to the distance of each microphone to each other are solved off-line and programmed into a host computer. In one embodiment, the set of simultaneous equations provide multiple solutions and the median of such solutions is picked as the final position. In another embodiment, an average of the multiple solutions is provided as the final position.

The present invention is intended to overcome one or more of the problems discussed above.

SUMMARY OF THE INVENTION

The present invention allows the installer to spread microphones evenly across a room to provide even sound coverage throughout the room. In this configuration, the microphone array does not form beams, but instead it forms 1000's of virtual microphone bubbles within the room. This system provides the same type of sound improvement as beam formers, but with the advantage of the microphones being evenly distributed throughout the room and the desired sound source can be focused on more effectively rather than steered to, while un-focusing undesired sound sources instead of rejecting out of beam signals. The implementations outlined below also provide the full three dimensional location and a more natural presentation of each sound within the room, which opens up many opportunities for location-based sound optimization, services and needs.

According to one aspect of the present invention, 3D position location of sound sources includes using propagation delay and known system speaker locations to form a dynamic microphone array. Then, using a bubble processor to derive a 3D matrix grid of a plurality (1000's) of virtual microphones in the room to focus the microphone array (in real-time using the calculated processing gain at each virtual bubble microphone) to the plurality of exact source sound coordinate locations (x,y,z). This aspect of the present invention can focus on the specific multiple speaking participants' locations, not just generalized vector or direction, while minimizing noise sources even if they are aligned in the same directional vector which would be along the same steered beam in a typical beam forming array. This allows the array to capture all participant locations (such as seated, standing, and or moving) to generate the best source sound pick up and optimizations. The participants in the active space are not limited to microphone locations and or steered beam optimized and estimated positional sound source areas for best quality sound pick up.

Because the array monitors all defined virtual microphone points in space all the time the best sound source decision is determined regardless of the current array position resulting in no desired sounds missed. Multiple sound sources can be picked up by the array and the external participants can have the option to focus on multiple or single sound sources resulting in a more involved and effective conference meeting without the typical switching positional estimation uncertainties, distortion and artifacts associated with steered beam former array.

By focusing instead of steering the microphone array, the noise floor performance is maintained at a consistent level, resulting in a user experience that is more natural, resulting in less artifacts, consistent ambient noise levels and post-processing to the audio output stream.

According to another aspect of the present invention, a method of focusing combined sound signals from a plurality of physical microphones in order to determine a processing gain for each of a plurality of virtual microphone locations in a shared 3D space, defines, by at least one processor, a plurality of virtual microphone bubbles in the shared 3D space, each bubble having location coordinates in the shared 3D space, each bubble corresponding to a virtual microphone. The at least one processor receives sound signals from the plurality of physical microphones in the shared 3D space, and determines a processing gain at each of the plurality of virtual microphone bubble locations, based on a received combination of sound signals sourced from each virtual microphone bubble location in the shared 3D space. The at least one processor identifies a sound source in the shared 3D space, based on the determined processing gains, the sound source having coordinates in the shared 3D space. The at least one processor focuses combined signals from the plurality of physical microphones to the sound source coordinates by adjusting a weight and a delay for signals received from each of the plurality of physical microphones. The at least one processor outputs a plurality of streamed signals comprising (i) real-time location coordinates, in the shared 3D space, of the sound source, and (ii) sound source processing gain values associated with each virtual microphone bubble in the shared 3D space.

According to a further aspect of the present invention, apparatus configured to focus combined sound signals from a plurality of physical microphones in order to determine a processing gain for each of a plurality of virtual microphone locations in a shared 3D space, each of the plurality of physical microphones being configured to receive sound signals in a shared 3D space, includes at least one processor. The at least one processor is configured to: (i) define a plurality of virtual microphone bubbles in the shared 3D space, each bubble having location coordinates in the shared 3D space, each bubble corresponding to a virtual microphone; (ii) receive sound signals from the plurality of physical microphones in the shared 3D space; (iii) determine a processing gain at each of the plurality of virtual microphone bubble locations, based on a received combination of sound signals sourced from each virtual microphone bubble location in the shared 3D space; (iv) identify a sound source in the shared 3D space, based on the determined processing gains, the sound source having coordinates in the shared 3D space; (v) focus combined signals from the plurality of physical microphones to the sound source coordinates by adjusting a weight and a delay for signals received from each of the plurality of physical microphones; and (vi) output a plurality of streamed signals comprising (i) real-time location coordinates, in the shared 3D space, of the sound source, and (ii) sound source processing gain values associated with each virtual microphone bubble in the shared 3D space.

According to yet another aspect of the present invention, A program embodied in a non-transitory computer readable medium for focusing combined sound signals from a plurality of physical microphones in order to determine a processing gain for each of a plurality of virtual microphone locations in a shared 3D space The program has instructions causing at least one processor to: (i) define a plurality of virtual microphone bubbles in the shared 3D space, each bubble having location coordinates in the shared 3D space, each bubble corresponding to a virtual microphone; (ii) receive sound signals from the plurality of physical microphones in the shared 3D space; (iii) determine a processing gain at each of the plurality of virtual microphone bubble locations, based on a received combination of sound signals sourced from each virtual microphone bubble location in the shared 3D space; (iv) identify a sound source in the shared 3D space, based on the determined processing gains, the sound source having coordinates in the shared 3D space; (v) focus combined signals from the plurality of physical microphones to the sound source coordinates by adjusting a weight and a delay for signals received from each of the plurality of physical microphones; and (vi) output a plurality of streamed signals comprising (i) real-time location coordinates, in the shared 3D space, of the sound source, and (ii) sound source processing gain values associated with each virtual microphone bubble in the shared 3D space.

In addition to the processor(s), the present embodiments are preferably composed of both algorithms and hardware accelerators.

BRIEF DESCRIPTION OF THE DRAWINGS

FIGS. 1*a* and 1*b* are diagrammatic illustrations of sound pressure correlated with distance.

FIG. 2 is a diagrammatic illustration of different sound wave types in relation to a microphone.

FIGS. 3*a* and 3*b* are structural and functional diagrams of the bubble processor and the microphone element processor, according to an embodiment of the present invention. FIG. 3*b* includes a flow chart for calculating processing gain.

FIG. 4 is a diagrammatic illustration of a 3D virtual microphone matrix derived by the bubble processor.

FIGS. 5*a* and 5B is a representation of the microphone to virtual microphone bubble, time relationship, and pattern.

FIGS. 6*a*, 6*b* & 6*c* processing gain vs. position graphs of the bubble processor.

FIG. 7 is an illustration of how the virtual microphone bubbles are arranged with a 1D array arrangement.

FIG. 8 is a diagrammatic illustration of the microphone focusing process

DETAILED DESCRIPTION OF THE PRESENTLY PREFERRED EXEMPLARY EMBODIMENTS

Figure 1B:
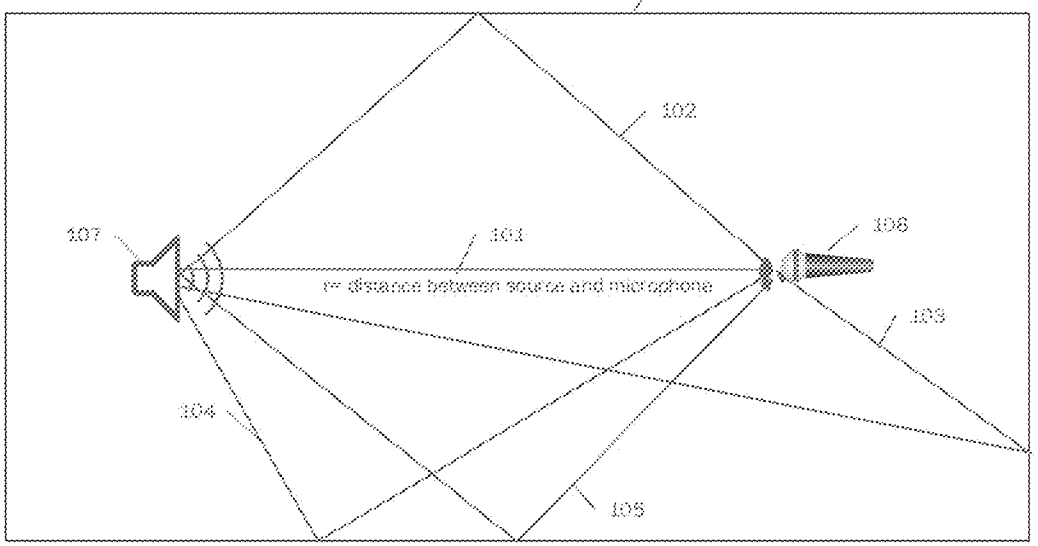

The present invention is directed to systems and methods that enable groups of people, known as participants, to join together over a network such as the Internet, or similar electronic channel, in a remotely distributed real-time fashion employing personal computers, network workstations, or other similarly connected appliances, without face-to-face contact, to engage in effective audio conference meetings that utilize large multi-user rooms (spaces) with distributed participants.

Advantageously, embodiments of the present invention pertain to utilizing the time domain to provide systems and methods to give remote participants the capability to focus an in-multi-user-room microphone array to the desired speaking participant and/or sound sources. And the present invention may be applied to any one or more shared spaces having multiple microphones for both focusing sound source pickup and simulating a local sound recipient for a remote listening participant.

Focusing the microphone array preferably comprises the process of optimizing the microphone array to maximize the process gain at the targeted virtual microphone (X,Y,Z) position, to increase the magnitude of the desired sound source while maintaining a constant ambient noise level in the shared space, resulting in a natural audio experience; and is specifically not the process of switching microphones, and/or steering microphone beam former array(s) to provide constant gain within the on-axis beam and rejecting the off axis signals resulting in an unnatural audio experience and inconsistent ambient noise performance.

A notable challenge to picking up sound clearly in a room, cabin or confined space is the multipath environment where the sound wave reaches the ear both directly and via many reflected paths. If the microphone is in close proximity to the source, then the direct path is very much stronger than the reflected paths and it dominates the signal. This gives a very clean sound. In the present invention, it is desirable to place the microphones unobtrusively and away from the sound source, on the walls or ceiling to get them out of the way of the participants and occupants.

FIGS. 1*a* and 1*b* illustrate that as microphone 108 is physically separated through distance from the sound source 107, the direct path's 101 sound pressure 110 level drops predictably following the 1/r rule 110, however the accumulation of the reflected paths 102,103,104,105 tend to fill the room 109 more evenly. As one moves the microphone 108 further from the sound source 107, the reflected sound waves 102,103,104,105 make up more of the microphone 108 measured signal. The measured signal sounds much more distant and harder to hear, even if it has sufficient amplitude, as the reflected sound waves 102,103,104,105 are dispersed in time, which causes the signal to be distorted, and effectively not as clear to a listener.

FIG. 2 illustrates sound signals arriving at the microphone array 205, modeled as having three components. The sound signal arriving directly 101 to the microphone array 205, the sound signal arriving at the microphone array 205 via reflections 202 from walls 206 and objects 207 within the room referred to as reverberation, and ambient sounds not coming from the desired sound source 107, as noise. Because of the extra distance traveled from the desired sound source 107 to the microphone array 205, the propagation delay or time the signal travels in free air will be longer for reflected signals 202.

FIG. 3*a* (300) is a functional diagram of the bubble processor and also Illustrates a flow chart outlining the logic to derive the processing gain to identify the position of the sound source 107. A purpose of the system is to create an improved sound output signal 315 by combining the inputs from the individual microphone elements 108 in the array 205 in a way that increases the magnitude of the direct sound 101 received at the microphone array relative to the reverb 202 and noise 203 components. For example, if the magnitude of the direct signal 101 can be doubled relative to the others signals 202,203, it will have roughly the same effect as halving the distance between the microphones 108 and the sound source 107. The signal strength when the array is focused on a sound source 107 divided by the signal strength when the array is not focused on any sound source 107 (such as ambient background noise, for example) is defined as the processing gain of the system. The present embodiment works by setting up thousands of listening positions (as shown in FIG. 4 and explained below) within the room, and simultaneously measuring the processing gain at each of these locations. The virtual listening position with the largest processing gain is preferably the location of the sound source 107.

To derive the processing gains 308, the volume of the room where sound pickup is desired is preferably divided into a large number of virtual microphone positions (FIG. 4). When the array is focused on a given virtual microphone 402, then any sound source within a close proximity of that location will produce an increased processing gain sourced from that virtual microphone 402. The volume around each virtual microphone 402 in which a sound source will produce maximum processing gain at that point, is defined as a bubble. Based on the location of each microphone and the defined 3D location for each virtual microphone, and using the speed of sound which can be calculated given the current measured room temperature, the system 300 can determine the expected propagation delay from each virtual microphone 402 to each microphone array element 108.

The flow chart in FIG. 3*a* illustrates the signal flow within the bubble processing unit 300. This example preferably monitors 8192 bubbles simultaneously. The sound from each microphone element 108 is sampled at the same time as the other elements within the microphone array 205 and at a fixed rate of 12 kHz. Each sample is passed to a microphone element processor 301 illustrated in FIG. 3*b*. The microphone element processor 301 preferably conditions and aligns the signals in time and weights the amplitude of each sample so they can be passed on to the summing node 304.

The signal components 320 from the microphone's element processor 301 are summed at node 304 to provide the combined microphone array 205 signal for each of the 8192 bubbles. Each bubble signal is preferably converted into a power signal at node 305 by squaring the signal samples. The power signals are then preferably summed over a given time window by the 8192 accumulators at node 307. The sums represent the signal energy over that time period.

The processing gain for each bubble is preferably calculated at node 308 by dividing the energy of each bubble by the energy of an ideal unfocused signal 322. The unfocused signal energy is preferably calculated by Summing 319 the energies of the signals from each microphone element 318 over the given time window, weighted by the maximum ratio combining weight squared. This is the energy that we would expect if all of the signals were uncorrelated. The processing gain 308 is then preferably calculated for each bubble by dividing the microphone array signal energy by the unfocused signal energy 322.

Processing Gain is achieved because signals from a common sound source all experience the same delay before being combined, which results in those signals being added up coherently, meaning that their amplitudes add up. If 12 equal amplitude and time aligned direct signals 101 are combined the resulting signal will have an amplitude 12× higher, or a power level 144× higher. Signals from different sources and signals from the same source with significantly different delays as the signals from reverb 202 and noise 203 do not add up coherently and do not experience the same gain. In the extremes, the signals are completely uncorrelated and will add up orthogonally. If 12 equal amplitude orthogonal signals are added up, the signal will have roughly 12× the power of the original signal or a 3.4× increase in amplitude (measured as rms). The difference between the 12× gain of the direct signal 101 and the 3.4× gain of the reverb (202) and noise signals (203) is the net processing gain (3.4 or 11 dB) of the microphone array 205 when it is focused on the sound source 107. This makes the signal sound as if the microphone 108 has moved 3.4× closer to the sound source. This example used a 12 microphone array 205 but it could be extended to an arbitrary number (N) resulting in a maximum possible processing gain of sqrt(N) or 10 log (N) dB.

The bubble processor system 300 preferably simultaneously focuses the microphone array 205 on 8192 points 402 in 3-D space using the method described above. The energy level of a short burst of sound signal (50-100 ms) is measured at each of the 8192 virtual microphone bubble 402 points and compared to the energy level that would be expected if the signals combined orthogonally. This gives us the processing gain 308 at each point. The virtual microphone bubble 402 that is closest to the sound source 107 should experience the highest processing gain and be represented as a peak in the output. Once that is determined, the location 403 is known.

Node 306 preferably searches through the output of the processing gain unit 308 for the bubble with the highest processing gain. The (x,y,z) location 301120 (FIG. 5*a*) of the virtual microphone 402 corresponding to that bubble can then be determined by looking up the index in the original configuration to determine the exact location of the Sound Source 107. The parameters 314 maybe communicated to various electronic devices to focus them to the identified sound source position 403. After deriving the location 403 of the sound source 107, focusing the microphone array 205 on that sound source 107 can be accomplished after achieving the gain. The Bubble processor 300 is designed to find the sound source 107 quickly enough so that the microphone array 205 can be focused while the sound source 107 is active which can be a very short window of opportunity. The bubble processor system 300 according to this embodiment is able to find new sound sources in less than 100 ms. Once found, the microphone array focuses on that location to pick up the sound source signal 310 and the system 300 reports the location of the sound through the Identify Source Signal Position 306 to other internal processes and to the host computer so that it can implement sound sourced location based applications. Preferably, this is the purpose of the bubble processor 300.

FIG. 8 illustrates the logic preferably used to derive the microphone focusing. Once the microphone bubble 402 that is closest to the sound source 107 is identified, the specific microphone delay 801 and weight 802 that are correlated to the specific virtual microphone are known. Each microphone signal is channeled through the specific delay 801, which is multiplied by the specific microphone signal weighting 802 for each microphone. The output from all the microphones is summed 803 and the resulting signal is channeled to the audio system 804.

The Mic Element Processor 301 and shown in FIG. 3*b*, is preferably the first process used to focus the microphone array 205 on a particular bubble 402. Individual signals from each microphone 108 are passed to a Precondition process 3017 (FIG. 3*b*). The Precondition 3017 process filters off low frequency and high frequency components of the signal resulting in an operating bandwidth of 200 Hz to 1000 Hz.

It may be expected that reflected signals 202 will be de-correlated from the direct signal 101 due to the fact that they have to travel a further distance and will be time-shifted relative to the desired direct signal 101. This is not true in practice, as signals that are shifted by a small amount of time will have some correlation to each other. A "small amount of time" depends on the frequency of the signal. Low frequency signals tend to de-correlate with delay much less than high frequency signals. Signals at low frequency spread themselves over many sample points and make it hard to find the source of the sound. For this reason, it is preferable to filter off as much of the low frequency signal as possible without losing the signal itself. High frequency signals also pose a problem because they de-correlate too fast. Since there cannot be an infinite number of virtual microphone bubbles (402) in the space, there should be some significant distance between them, say 200 mm. The focus volume of the virtual microphone bubble (402) becomes smaller as the frequency increases because the tiny shift in delays has more of an effect. If the bubbles volumes get too small, then the sound source may fall between two sample points and get lost. By restricting the high frequency components, the virtual microphone bubbles (402) will preferably be big enough that sound sources (309) will not be missed by a sample point in the process algorithm. The signal is preferably filtered and passed to the Microphone Delay line function 3011.

A delay line 3011 (FIG. 3*a* and FIGS. 5*a* and 5*b*) preferably stores the pre-conditioned sample plus a finite number of previously pre-conditioned samples from that microphone element 108. During initialization, the fixed virtual microphone 402 positions and the calculated microphone element 108 positions are known. For each microphone element 108, the system preferably calculates the distance to each virtual microphone 402 then computes the added delay needed for each virtual microphone and preferably writes it to delay look up table 3012. It also computes the maximal ratio combining weight for each virtual microphone 402 and stores that in the weight lookup table 3014.

A counter 3015, preferably running at a sample frequency of more than 8192 times that of the microphone sample rate, counts bubble positions from 0 to 8191 and sends this to the index of the two look up tables 3012 and 3014. The output of the bubble delay lookup table 3012 is preferably used to choose that tap of the delay line 3011 with the corresponding delay for that bubble. That sample is then preferably multiplied 3013 by the weight read from the weight lookup table 3014. For each sample input to the microphone element processor 301, 8192 samples are output 3018, each corresponding to the signal component for a particular virtual microphone bubble 402 in relation to that microphone element 108.

The second method by which the array may be used to improve the direct signal strength is by applying a specific weight to the output of each microphone element 108. Because the microphones 108 are not co-located in the exact same location, the direct sound 101 will not arrive at the microphones 108 with equal amplitude. The amplitude drops as 1/r 110 and the distance (r) is different for each combination of microphone 108 and virtual microphone bubble 402. This creates a problem as mixing weaker signals 310 into the output at the same level as stronger signals 310 can actually introduce more noise 203 and reverb 202 into the system 300 than not. Maximal Ratio Combining is the preferable way of combining signals 304. Simply put, each signal in the combination should be weighted 3014 proportionally by the amplitude of the signal component to result in the highest signal to noise level. Since the distance that each direct path 101 travels from each bubble position 402 to each microphone 108 is known, and since the 1/r law is also known, this can be used to calculate the optimum weighting 3014 for each microphone 108 at each of the 8192 virtual microphone points 402.

FIGS. 5*a* and 5*b* 3011 show the relationship of any one bubble 402 to each microphone 108. As each bubble 402 will have a unique propagation delay 30115 to the microphones 108, a dynamic microphone bubble 402 to array pattern 30111 is developed. This pattern is unique to that dynamic microphone bubble location 403. This results in a propagation delay pattern 30111 to processing-gain matrix 315 that is determined in FIGS. 3*a* and 3*b*. Once the max processing gain 300 in determined from the 8192 dynamic microphone bubbles 400, the delay pattern 30111 will determine the unique dynamic microphone bubble location 403. The predefined bubble locations 301120 are calculated based on room size dimensions 403 and the required spacing to resolve individual bubbles, which is frequency dependent.

The present embodiment is designed with a target time delay, D, 30117 as shown in FIG. 5*b*, between sound source 107 and where the microphone element inputs are combined 304 to have delay D by manipulating the delay 30118 that is inserted after each microphone element measured delay 30115. The value of D may be held constant at a value that is greater than the expected maximum delay of the furthest sound source in the room. Alternatively, D can be dynamically changed so the smallest inserted delay 30118 for all microphone paths is at or close to zero, to minimize the total delay through the system. The calculated propagation delay from a given virtual microphone 402 to a microphone 108 plus the inserted delay 30118 always adds up to D 30117. For example, if the delay from virtual microphone 1 to microphone element 1 is 16 ms and D is 40 ms, then 24 ms will be inserted into that path 3018. If the delay from virtual microphone 1 to microphone element 2 is 21 ms, then an additional 19 ms is inserted to that path. Graph 30119 (FIG. 5*b*) demonstrates this relationship of measured delay 30115 to added delay 30118 to achieved a constant delay time 30117 across all microphones 108 in the array 205. If there is a sound source 107 within the bubble associated with that virtual microphone 402, then the direct path signals 101 from both microphone elements will arrive at the summing point 304 with the same amount of delay 30117 (40 ms) then the two direct signals will add in-phase to create a stronger signal. The Process 3011 is repeated for all 12 microphones in the array 205 in this example.

The challenge now is how to compute the 8192 sample points in real-time so that the system can pick up a sound source and focus on it as it happens. The challenge is very computation and memory bandwidth intensive. For each microphone at each virtual microphone bubble 402 point in the room, there are five simple operations: fetch the required delay 3012 to add to this path, fetch the required weight 3014, fetch the signal from a delay line 3011, multiply the signal by the weight 3013, and add the result to the total signal 304. The implementation of this embodiment is for 12 microphones 205, at each of the 8192 virtual microphone 402 sample points, at the base sample frequency of 12 kHz. The total operation count is 12×8192×12000×5 operations=5.9 billion operations per second. The rest of the calculation (filters, power calculation, peak finding, etc.) is still large but insignificant compared to this number. While this operation count is possible with a high-end computer system, it is not economical. Implementation of the process is preferably on a field programmable gate array (FPGA) or, equivalently, it could be implemented on an ASIC. On the FPGA, is a processor core that can preferably do all five of the basic operations in parallel in a single clock cycle. Twelve copies of the processor core are preferably provided, one for each microphone to allow for sufficient processing capability. This system now can compute 60 operations in parallel and operate at a modest clock rate of 100 MHz. A small DSP processor for filtering and final array processing is preferably used.

FIGS. 6*a*, 6*b*, and 6*c* demonstrate the function of the bubble processor on a real sound wave. In general, the positions of the bubbles are arbitrary in 3D space. In this example the bubble processor breaks up the 3D space into a plurality of 2D planes. The number of 2D planes 601, 602,603,604,605 is configurable and based on the virtual microphone bubble size, as the 2D planes are stacked on top of each other from floor to ceiling as shown in FIG. 6*a*. FIG. 6B shows a processing graph of 2D plane 603 that is representative of any of the other 2D planes 601-605. A plot of a subset of the bubble outputs with respect to their corresponding positions on the x- and y-axes 607 with the processing gain 606 plotted as the altitude of the surface along the z-axis. The figures show effectively a captured horizontal 2D plane 603 across a room 401 for virtual microphones in that particular 2D plane from a plurality of possible 2D planes.

FIG. 6*b* shows a processing graph of 2D plane 603 when there is only room ambient noise, resulting is no indication of significant processing gain amongst any of the virtual microphone bubble locations. When a distinct sound source is added, FIG. 6*c*, then there is a distinct peak 608 in the processing gain of 2D plane 603 at the position of the sound source. The extra bumps are measured because real signals are not perfectly uncorrelated when they are delayed resulting in residual processing gain 308 derived at other virtual microphone bubble 402 301120.

FIG. 4 (400) illustrates a room 401 of any dimension that is volumetrically filled with virtual microphone bubbles 402. The Bubble processor system 300 as presently preferred is set up (but not limited) to measure 8192 concurrent virtual microphone bubbles 402. The illustration only shows a subset of the virtual microphones bubbles 402 for clarity. The room 401 is filled such that from a volumetric perspective all volume is covered with the virtual microphone bubbles 402 which are arranged in a 3D grid with (X,Y,Z) vectors 403. By deriving the Process Gain 308 sourced from each virtual microphone bubble location 301120, the exact coordinates of the sound source 309 can be measured in an (X,Y,Z) coordinate grid 403. This allows for precise location determination to a high degree of accuracy, which is limited by virtual microphone bubble 402 size. The virtual microphone bubble 402 size and position of each virtual microphone 402) is pre-calculated based on room size and bubble size desired which is configurable. The virtual microphone bubble parameters include, but are not limited to, size and coordinate position. The parameters are utilized by the Bubble Processor system 300 throughout the calculation process to derive magnitude and positional information for each virtual microphone bubble 402 position. The virtual processing plane slice 603 is further illustrated for reference.

FIG. 7 (700) illustrates another embodiment of the system utilizing a 1D beam forming array. A simplification of the system is to constrain all of the microphones 702 into a line 704 in space. Because of the rotational symmetry 703 around the line 704, it is virtually impossible to distinguish the difference between sound sources that originate from different points around a circle 703 that has the line as an axis. This turns the microphone bubbles described above into donuts 703 (essentially rotating the bubble 402 around the microphone axis). A difference is that the sample points are constrained to a plane 705 extending from one side of the microphone line (one sample point for each donut). Positions are output as 2D coordinates with a length and width position coordinate 706 from the microphone array, not as a full 3D coordinate with a height component as illustrated in the diagram.

The individual components shown in outline or designated by blocks in the attached Drawings are all well-known in the electronic processing arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of real-time, low-latency sound source location targeting in the presence of reverb and ambient noise signals in a shared three-dimensional space, comprising:

predefining, in the shared three-dimensional space, a three-dimensional coordinate grid of a plurality of virtual-microphone locations, each of which is related to a plurality of physical microphones in the shared three-dimensional space, so as to define, for each virtual-microphone location, delay and weight factors with respect to each related physical microphone in the shared three-dimensional space;

at least one processor core provided for each physical microphone, for parallel-process-calculating, for each physical microphone with respect to each virtual microphone location, sound source location by:

fetching from memory the delay factor for each virtual microphone location with respect to the corresponding physical microphone;

fetching from memory the weight factors for each virtual microphone location with respect to the corresponding physical microphone;

fetching from memory at least one sound source signal from the corresponding physical microphone in the shared three-dimensional space;

using at least one delay line to process the fetched at least one sound source signal from the corresponding physical microphone using the fetched delay factor to produce a delayed sound source signal for each virtual microphone location; and multiplying the delayed sound source signal by the fetched weight factor for each virtual microphone to produce a delayed and weighted sound source signal for each virtual microphone for the corresponding physical microphone;

summing the delayed and weighted sound source signals from all of the processor cores to provide a summed total signal corresponding to each virtual microphone location;

measuring the energy of the summed total signal for each virtual microphone location;

determining, from the measured energy of each summed signal, a three-dimensional grid coordinate location for each sound source with respect to each virtual microphone location in the shared three-dimensional space; and outputting, in real-time, the determined three-dimensional grid location coordinates and signal strengths of all of the sound sources in the shared three-dimensional space.

2. The method according to claim 1, wherein the predefining of the three-dimensional coordinate grid includes predefining of more than 1000 virtual-microphone locations.

3. The method according to claim 1, wherein the at least one processor core parallel-process-calculates, for each physical microphone with respect to each virtual microphone location, the sound source location within a single a clock cycle.

4. The method according to claim 1, wherein the coordinates in the shared three-dimensional space are defined in (x,y,z) coordinates.

5. The method according to claim 1, wherein a largest signal strength among the determined three-dimensional grid location coordinates corresponds to a location of the sound source.

6. The method according to claim 1, wherein signal strength increases with increases in magnitude of direct sound from the sound source relative to the reverb and noise in the shared three-dimensional space.

7. The method according to claim 1, wherein the at least one processor determines an expected propagation delay from each virtual-microphone to each physical microphone.

8. The method according to claim 1, wherein the at least one processor (i) samples the signals from the plurality of physical microphones at the same time and at a fixed rate, (ii) conditions and aligns the samples in time and weights the amplitude of each sample, and (iii) combines the conditioned and aligned samples.

9. The method according to claim 1, wherein the coordinates in the shared three-dimensional space are evenly distributed.

10. The method according to claim 1, wherein the coordinates in the shared three-dimensional space are not evenly distributed.

11. Apparatus for real-time, low-latency sound source location targeting in the presence of reverb and ambient noise signals in a shared three-dimensional space, comprising:

at least one processor predefining, in the shared three-dimensional space, a three-dimensional coordinate grid of a plurality of virtual-microphone locations, each of which is related to a plurality of physical microphones in the shared three-dimensional space, so as to define, for each virtual-microphone location, delay and weight factors with respect to each related physical microphone in the shared three-dimensional space;

the at least one processor including at least one processor core for each physical microphone, for parallel-process-calculating, for each physical microphone with respect to each virtual microphone location, sound source location by:

fetching from memory the delay factor for each virtual microphone location with respect to the corresponding physical microphone;

fetching from memory the weight factors for each virtual microphone location with respect to the corresponding physical microphone;

fetching from memory at least one sound source signal from the corresponding physical microphone in the shared three-dimensional space;

using at least one delay line to process the fetched at least one sound source signal from the corresponding physical microphone using the fetched delay factor to produce a delayed sound source signal for each virtual microphone location; and multiplying the delayed sound source signal by the fetched weight factor for each virtual microphone to produce a delayed and weighted sound source signal for each virtual microphone for the corresponding physical microphone;

summing the delayed and weighted sound source signals from all of the processor cores to provide a summed total signal corresponding to each virtual microphone location;

measuring the energy of the summed total signal for each virtual microphone location;

determining, from the measured energy of each summed signal, a three-dimensional grid coordinate location for each sound source with respect to each virtual microphone location in the shared three-dimensional space; and outputting, in real-time, the determined three-dimensional grid location coordinates and signal strengths of all of the sound sources in the shared three-dimensional space.

12. The apparatus according to claim 11, wherein the at least one processor comprises at least one microphone processor and at least one bubble processor.

13. The apparatus according to claim 11, wherein the at least one processor predefines the three-dimensional coordinate grid to include predefining of more than 1000 virtual-microphone locations.

14. The apparatus according to claim 11, wherein the at least one processor core parallel-process-calculates, for each physical microphone with respect to each virtual microphone location, the sound source location within a single a clock cycle.

15. The apparatus according to claim 11, wherein the at least one processor defines the coordinates in the shared three-dimensional space as (x,y,z) coordinates.

16. The apparatus according to claim 11, wherein the at least one processor determines that a largest signal strength among the determined three-dimensional grid location coordinates corresponds to a location of the sound source.

17. The apparatus according to claim 11, wherein the at least one processor determines an expected propagation delay from each virtual-microphone to each physical microphone.

18. The apparatus according to claim 11, wherein the at least one processor (i) samples the signals from the plurality of physical microphones at the same time and at a fixed rate, (ii) conditions and aligns the samples in time and weights the amplitude of each sample, and (iii) combines the conditioned and aligned samples.

19. The apparatus according to claim 11, wherein the physical microphones are configured as a linear array.

20. The apparatus according to claim 11, wherein the physical microphones are configured as a non-linear array.

21. A non-transitory computer readable medium storing a program for real-time, low-latency sound source location targeting in the presence of reverb and ambient noise signals in a shared three-dimensional space, said program comprising instructions causing at least one processor to:

predefine, in the shared three-dimensional space, a three-dimensional coordinate grid of a plurality of virtual-microphone locations, each of which is related to a plurality of physical microphones in the shared three-dimensional space, so as to define, for each virtual-microphone location, delay and weight factors with respect to each related physical microphone in the shared three-dimensional space;

the at least one processor providing at least one processor core for each physical microphone, for parallel-process-calculating, for each physical microphone with respect to each virtual microphone location, sound source location by:

fetching from memory the delay factor for each virtual microphone location with respect to the corresponding physical microphone;

fetching from memory the weight factors for each virtual microphone location with respect to the corresponding physical microphone;

fetching from memory at least one sound source signal from the corresponding physical microphone in the shared three-dimensional space;

using at least one delay line to process the fetched at least one sound source signal from the corresponding physical microphone using the fetched delay factor to produce a delayed sound source signal for each virtual microphone location; and multiplying the delayed sound source signal by the fetched weight factor for each virtual microphone to produce a delayed and weighted sound source signal for each virtual microphone for the corresponding physical microphone;

summing the delayed and weighted sound source signals from all of the processor cores to provide a summed total signal corresponding to each virtual microphone location;

measuring the energy of the summed total signal for each virtual microphone location;

determining, from the measured energy of each summed signal, a three-dimensional grid coordinate location for each sound source with respect to each virtual microphone location in the shared three-dimensional space; and outputting, in real-time, the determined three-dimensional grid location coordinates and signal strengths of all of the sound sources in the shared three-dimensional space.

22. The non-transitory computer readable medium according to claim 21, wherein said program comprises instructions for (i) at least one microphone processor and (ii) at least one bubble processor.

23. The non-transitory computer readable medium according to claim 21, wherein said program causes the at least one processor to predefine the three-dimensional coordinate grid to include more than 1000 virtual-microphone locations.

24. The non-transitory computer readable medium according to claim 21, wherein said program causes each at least one processor core to parallel-process-calculate, for each physical microphone with respect to each virtual microphone location, the sound source location within a single a clock cycle.

25. The non-transitory computer readable medium according to claim 21, wherein said program causes the at least one processor to define the coordinates in the shared three-dimensional space as (x,y,z) coordinates.

26. The non-transitory computer readable medium according to claim 21, wherein said program causes the at least one processor to determine that a largest signal strength among the determined three-dimensional grid location coordinates corresponds to a location of the sound source.

27. The non-transitory computer readable medium according to claim 21, wherein said program causes the at least one processor to determine an expected propagation delay from each virtual-microphone to each physical microphone.

* * * * *